US011715416B1

(12) United States Patent
Watsuda et al.

(10) Patent No.: US 11,715,416 B1
(45) Date of Patent: Aug. 1, 2023

(54) METHOD FOR DRIVING AN ACTIVE-MATRIX PIXEL ARRAY

(71) Applicant: Innolux Corporation, Miaoli County (TW)

(72) Inventors: Hirofumi Watsuda, Miaoli County (TW); Tzu-Min Yan, Miaoli County (TW); Tsau-Hua Hsieh, Miaoli County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/976,871

(22) Filed: Oct. 31, 2022

(51) Int. Cl.
*G09G 3/32* (2016.01)

(52) U.S. Cl.
CPC ..... *G09G 3/32* (2013.01); *G09G 2300/08* (2013.01); *G09G 2310/0272* (2013.01); *G09G 2310/061* (2013.01)

(58) Field of Classification Search
CPC ..... G09G 3/32; G09G 2300/08; G09G 2310/0272; G09G 2310/061
See application file for complete search history.

(56) References Cited

U.S. PATENT DOCUMENTS

| | | | | |
|---|---|---|---|---|
| 8,878,757 | B2 * | 11/2014 | Yoshida | G09G 3/3648 345/84 |
| 10,657,895 | B2 * | 5/2020 | Chaji | G09G 3/006 |
| 2014/0292740 | A1 | 10/2014 | Tseng et al. | |
| 2019/0287452 | A1 * | 9/2019 | Wang | G09G 3/325 |
| 2020/0302856 | A1 * | 9/2020 | Lin | G09G 3/2007 |
| 2021/0210000 | A1 * | 7/2021 | Lee | G09G 3/32 |

* cited by examiner

*Primary Examiner* — Andrew Sasinowski
(74) *Attorney, Agent, or Firm* — JCIPRNET

(57) ABSTRACT

A method for driving an active-matrix pixel array is provided. The method includes the following steps: during a first period, inputting a data signal into a control terminal of a second transistor of the each of pixel circuits from a first terminal of a first transistor of the each of the pixel circuits; during a second period, turning-on a third transistor of the each of the pixel circuits, so that a current generated by according to the data signal flows through the light emitting unit of the each of the pixel circuits; and during a third period, inputting a reset signal into the control terminal of the second transistor of the each of the pixel circuits from the first terminal of the first transistor of the each of the pixel circuits.

20 Claims, 13 Drawing Sheets

METHOD FOR DRIVING AN ACTIVE-MATRIX PIXEL ARRAY

BACKGROUND

Technical Field

The disclosure relates a circuit driving method; particularly, the disclosure relates to a method for driving an active-matrix (AM) pixel array.

Description of Related Art

In general, since the drive transistors in the pixel array of the display device, for example, the active-matrix light emitting diode (AM-LED) display, may be continuously driven by different driving voltages, the voltage of the drive transistors may have hysteresis characteristics due to the sweep voltage. As a result, the image retention phenomenon occurs on the screen of the display device.

SUMMARY

A method of the disclosure is adapted for driving an active-matrix (AM) pixel array. The active-matrix pixel array includes a plurality of pixel circuits. Each of the pixel circuits includes a first transistor, a second transistor, a third transistor and a light emitting unit. The method includes: during a first period, inputting a data signal into a control terminal of the second transistor of the each of the pixel circuits from a first terminal of the first transistor of the each of the pixel circuits; during a second period, turning-on the third transistor of the each of the pixel circuits, so that a current generated by according to the data signal flows through the light emitting unit of the each of the pixel circuits; and during a third period, inputting a reset signal into the control terminal of the second transistor of the each of the pixel circuits from the first terminal of the first transistor of the each of the pixel circuits. The reset signal has a first voltage. When the second transistor is a P-type transistor, the first voltage is greater than or equal to a voltage of a source terminal of the second transistor. When the second transistor is a N-type transistor, the first voltage is less than or equal to the voltage of a source terminal of the second transistor.

Based on the above, the method for driving the active-matrix pixel array of the disclosure can effectively drive the light emitting unit of the each of the pixel circuits in the pixel array to achieve a good display effect.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
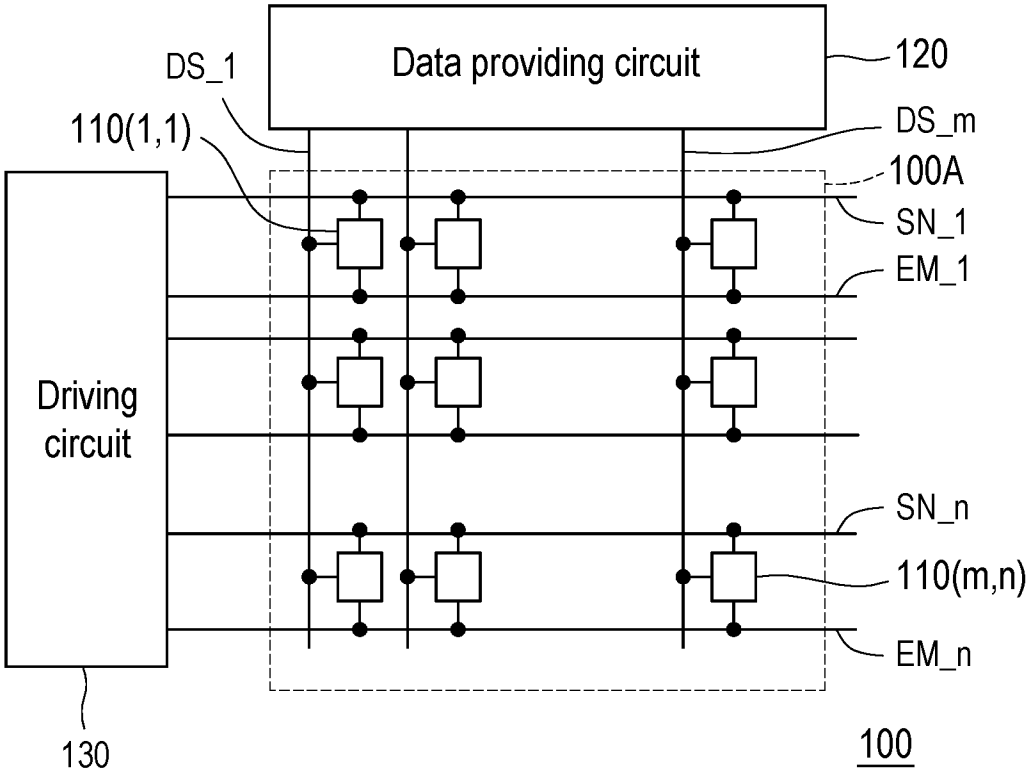
FIG. 1 is circuit schematic diagram of an electronic device according to an embodiment of the disclosure.

Reference will now be made in detail to the exemplary embodiments of the disclosure, examples of which are illustrated in the accompanying drawings. Whenever possible, the same reference numbers are used in the drawings and the description to refer to the same or like components.

Certain terms are used throughout the specification and appended claims of the disclosure to refer to specific components. Those skilled in the art should understand that electronic device manufacturers may refer to the same components by different names. This article does not intend to distinguish those components with the same function but different names. In the following description and rights request, the words such as "comprise" and "include" are open-ended terms, and should be explained as "including but not limited to . . . ".

The term "coupling (or electrically connection)" used throughout the whole specification of the present application (including the appended claims) may refer to any direct or indirect connection means. For example, if the text describes that a first device is coupled (or connected) to a second device, it should be interpreted that the first device may be directly connected to the second device, or the first device may be indirectly connected through other devices or certain connection means to be connected to the second device. The terms "first", "second", and similar terms mentioned throughout the whole specification of the present application (including the appended claims) are merely used to name discrete elements or to differentiate among different embodiments or ranges. Therefore, the terms should not be regarded as limiting an upper limit or a lower limit of the quantity of the elements and should not be used to limit the arrangement sequence of elements. In addition, wherever possible, elements/components/steps using the same reference numerals in the drawings and the embodiments represent the same or similar parts. Reference may be mutually made to related descriptions of elements/components/steps using the same reference numerals or using the same terms in different embodiments.

It should be noted that in the following embodiments, the technical features of several different embodiments may be replaced, recombined, and mixed without departing from the spirit of the disclosure to complete other embodiments. As long as the features of each embodiment do not violate the spirit of the disclosure or conflict with each other, they may be mixed and used together arbitrarily.

FIG. 1 is circuit schematic diagram of an electronic device according to an embodiment of the disclosure. Referring to FIG. 1, an electronic device 100 may be an active-matrix light emitting diode (AM-LED) display. The electronic device 100 includes an active-matrix pixel array 100A, a data providing circuit 120 and a driving circuit 130. The active-matrix pixel array 100A may include a plurality of pixel circuits 110(1,1) to 110(*m*,*n*), where m and n are positive integers. The data providing circuit 120 may be coupled to the pixel circuits 110(1,1) to 110(*m*,*n*) of the active-matrix pixel array 100A through a plurality of data lines DS_1 to DS_m. The driving circuit 130 may be coupled to the pixel circuits 110(1,1) to 110(*m*,*n*) of the active-matrix pixel array 100A through a plurality of scan lines and a plurality of control lines. In the embodiment of the disclosure, the data providing circuit 120 may provide data signal to the pixel circuits 110(1,1) to 110(*m*,*n*) of the active-matrix pixel array 100A through the plurality of data lines. The driving circuit 130 may provide a plurality of scan signals SN_1~SN_n and a plurality of emission signals EM_1 to EM_n to the pixel circuits 110(1,1) to 110(*m*,*n*) of the active-matrix pixel array 100A through the scan lines and the control lines.

Figure 2:
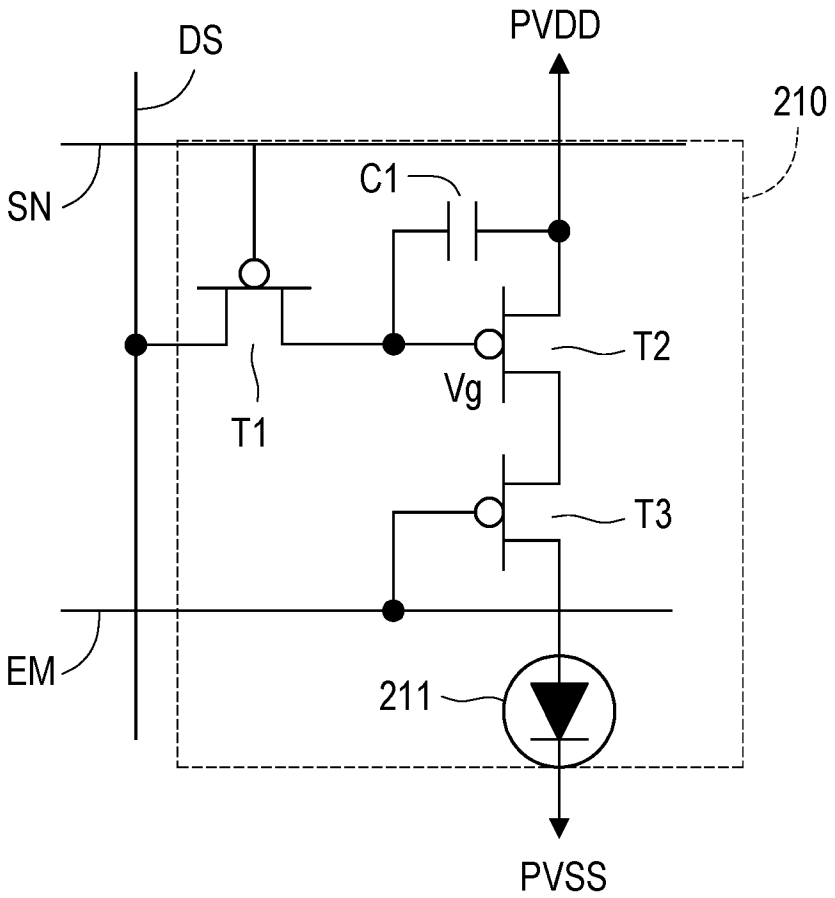
FIG. 2 is circuit schematic diagram of an active-matrix pixel array according to an embodiment of the disclosure.

FIG. 2 is circuit schematic diagram of an active-matrix pixel array according to an embodiment of the disclosure. Referring to FIG. 2, each of the pixel circuits 110(1,1) to 110(*m*,*n*) of FIG. 1 may implemented as a pixel circuit 210 of FIG. 2. In the embodiment of the disclosure, the pixel circuit 210 includes a first transistor T1 (or called a scan transistor), a second transistor T2 (or called a drive transistor), a third transistor T3 (or called an emission transistor), a capacitor C1 and a light emitting unit 211. The light emitting unit 211 may be a light emitting diode (LED). In the embodiment of the disclosure, a first terminal of the first transistor T1 is coupled to a control terminal of the second transistor T2 and a terminal of the capacitor C1. A second terminal of the first transistor T1 is coupled to a data line DS. A control terminal of the first transistor T1 is coupled to a scan line. A first terminal of the second transistor T2 is coupled to another terminal of the capacitor C1 and a first operation voltage PVDD. A second terminal of the second transistor T2 is coupled to a first terminal of the third transistor T3. A second terminal of the third transistor T3 is coupled to a terminal of the light emitting unit 211. Another terminal of the light emitting unit 211 is coupled to a second operation voltage PVSS. A control terminal of the third transistor T3 is coupled to a control line.

In the embodiment of the disclosure, the first transistor T1, the second transistor T2 and the transistor T3 are P-type transistors (e.g. P-type thin-film transistor (TFT)). The first terminal of each of the above-mentioned transistors may be a source terminal. The second terminal of each of the above-mentioned transistors may be a drain terminal. The control terminal of each of the above-mentioned transistors may be a gate terminal.

In the embodiment of the disclosure, the data line DS may provide a data signal and a reset signal to the second terminal of the first transistor T1 in the different times, and the scan line may provide a scan signal SN to the control terminal of the first transistor T1. When the first transistor T1 is turned-on, the data signal or the reset signal may be inputted into the control terminal of the second transistor T2 from the first terminal of the first transistor T1. The control line may provide an emission signal EM to the control terminal of the third transistor T3 to turn-on the third transistor T3, so that a current generated by according to the data signal flows through the light emitting unit 211. Therefore, the light emitting unit 211 may be effectively driven.

Figure 3:
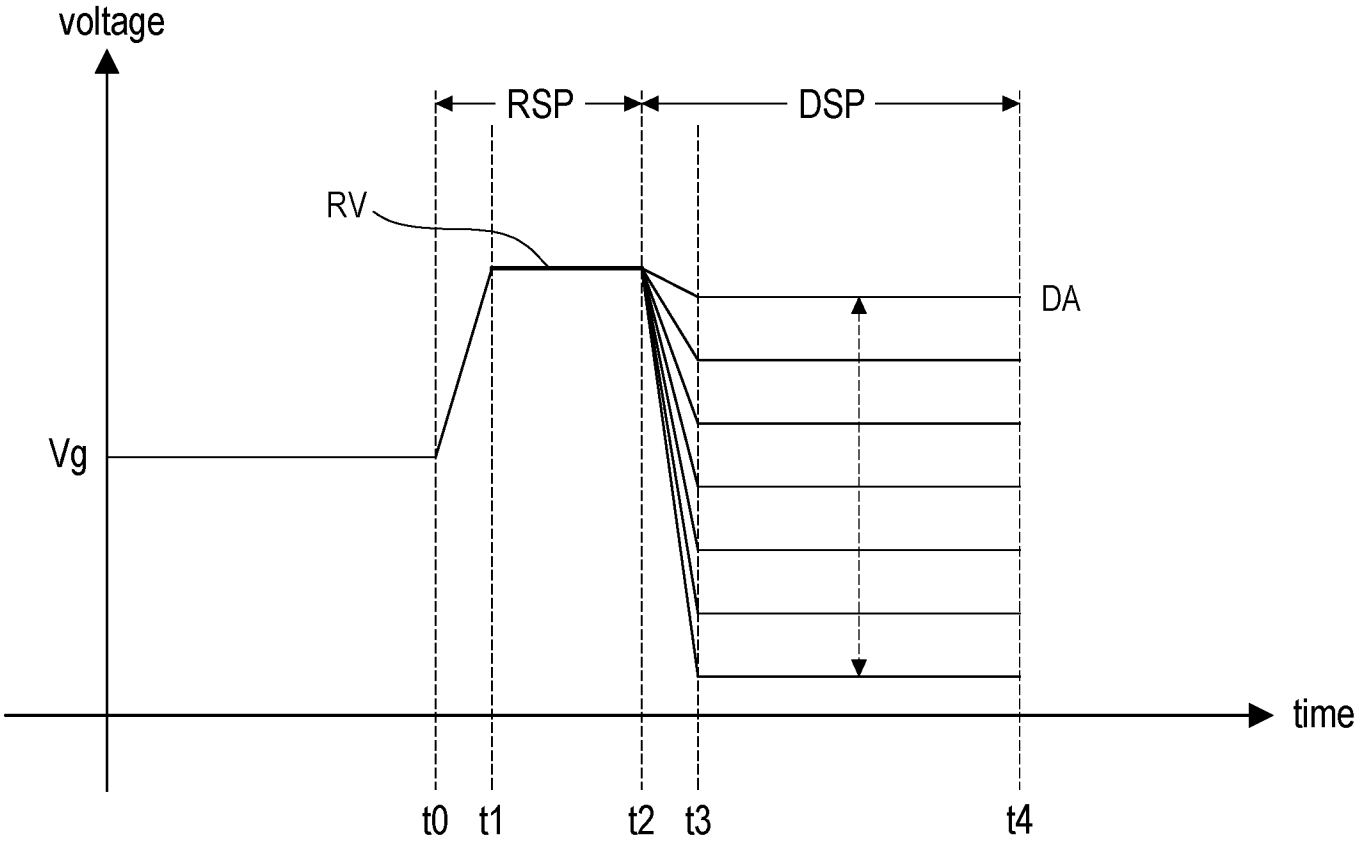
FIG. 3 is schematic diagram of a voltage of the control terminal of the second transistor according to an embodiment of the disclosure.

FIG. 3 is schematic diagram of a voltage of the control terminal of the second transistor according to an embodiment of the disclosure. Referring to FIG. 2 and FIG. 3, the voltage change of the voltage Vg of the control terminal (gate terminal) of the second transistor T2 may be implemented as shown in FIG. 3. In the embodiment of the disclosure, before to time t0, the data line DS may transmit a data voltage of a previously frame. During a reset scan period RSP from time t0 to time t1, the voltage Vg of the control terminal of the second transistor T2 may rise to a reset voltage RV as the reset signal. During the reset scan period RSP from time t1 to time t2, the reset signal is maintained at the reset voltage RV. During a data scan period DSP from time t2 to time t3, the voltage Vg of the control terminal of the second transistor T2 may fall to a data voltage DA as the data signal. The data voltage DA may be selected from a specifical voltage range. During the data scan period DSP from time t3 to time t4, the voltage Vg of the control terminal of the second transistor T2 is maintained at the data voltage DA.

In the embodiment of the disclosure, due to the data signals respectively having different data voltages may be transmitted to the control terminal of the second transistor in adjacent data scan periods (or adjacent frame periods), such as the data scan period before to time t0 and the data scan period DSP from time t3 to time t4, the reset voltage RV of the reset signal may be determined to be greater than or equal to the data voltage DA of the data signal to reset the voltage (i.e. a gate-source voltage Vgs) between control terminal (gate terminal) and the first terminal (source terminal) of the second transistor T2, so as to reduce or eliminate the hysteretic characteristics of the second transistor T2 due to the sweep voltage (Vgs) of the second transistor T2. In the embodiment of the disclosure, the reset voltage RV of the reset signal may be greater than or equal to a voltage of the first terminal (source terminal) of the second transistor T2.

In other embodiments of the disclosure, the reset voltage RV of the reset signal may be greater than or equal to a highest data voltage of the data signal. In other embodiments of the disclosure, the reset voltage RV of the reset signal may be greater than or equal to the first operation voltage PVDD.

Figure 4:
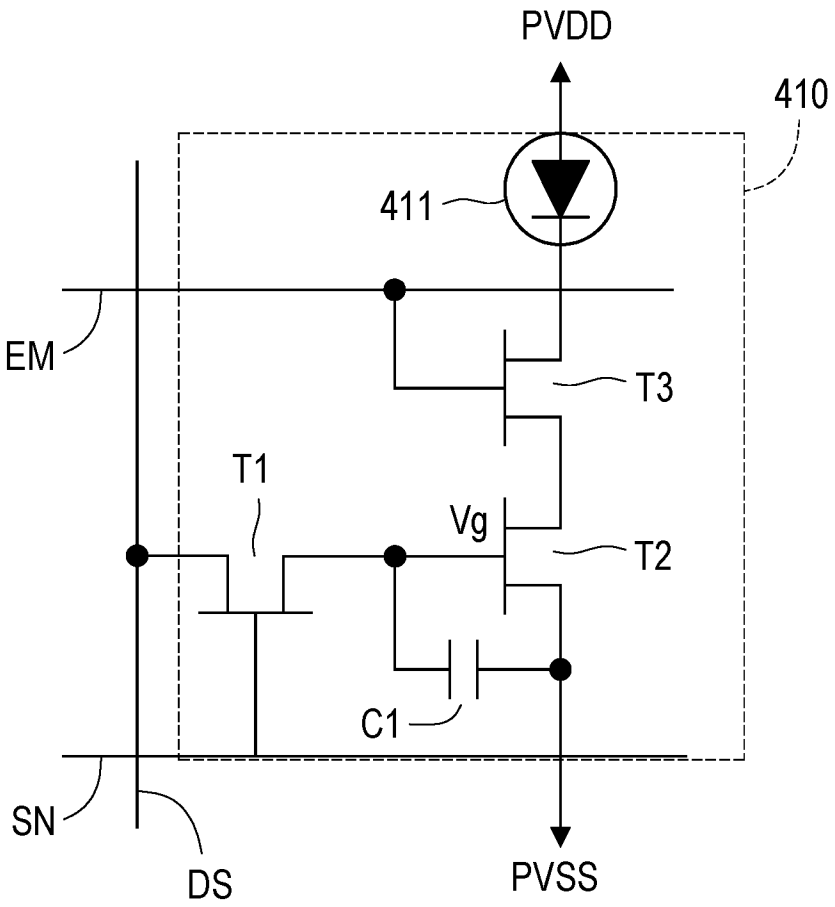
FIG. 4 is circuit schematic diagram of an active-matrix pixel array according to another embodiment of the disclosure.

FIG. 4 is circuit schematic diagram of an active-matrix pixel array according to another embodiment of the disclosure. Referring to FIG. 4, each of the pixel circuits 110(1,1) to 110(*m*,*n*) of FIG. 1 may implemented as a pixel circuit 410 of FIG. 4. In the embodiment of the disclosure, the pixel circuit 410 includes a first transistor T1, a second transistor T2, a third transistor T3, a capacitor C1 and a light emitting unit 411. The light emitting unit 411 may be a light emitting diode (LED). In the embodiment of the disclosure, a first terminal of the first transistor T1 is coupled to a control terminal of the second transistor T2 and a terminal of the capacitor C1. A second terminal of the first transistor T1 is coupled to a data line DS. A control terminal of the first transistor T1 is coupled to a scan line. A first terminal of the second transistor T2 is coupled to another terminal of the capacitor C1 and a second operation voltage PVSS. A second terminal of the second transistor T2 is coupled to a first terminal of the third transistor T3. A second terminal of the third transistor T3 is coupled to a terminal of the light emitting unit 411. Another terminal of the light emitting unit 411 is coupled to a first operation voltage PVDD. A control terminal of the third transistor T3 is coupled to a control line.

In the embodiment of the disclosure, the first transistor T1, the second transistor T2 and the transistor T3 are N-type transistors (e.g. N-type TFT). The first terminal of each of the above-mentioned transistors may be a source terminal. The second terminal of each of the above-mentioned transistors may be a drain terminal. The control terminal of each of the above-mentioned transistors may be a gate terminal.

In the embodiment of the disclosure, the data line DS may provide a data signal and a reset signal to the second terminal of the first transistor T1 in the different times, and the scan line may provide a scan signal SN to the control terminal of the first transistor T1. When the first transistor T1 is turned-on, the data signal or the reset signal may be inputted into the control terminal of the second transistor T2 from the first terminal of the first transistor T1. The control line may provide an emission signal EM to the control terminal of the third transistor T3 to turn-on the third transistor T3, so that a current generated by according to the data signal flows through the light emitting unit 411. Therefore, the light emitting unit 411 may be effectively driven.

Figure 5:
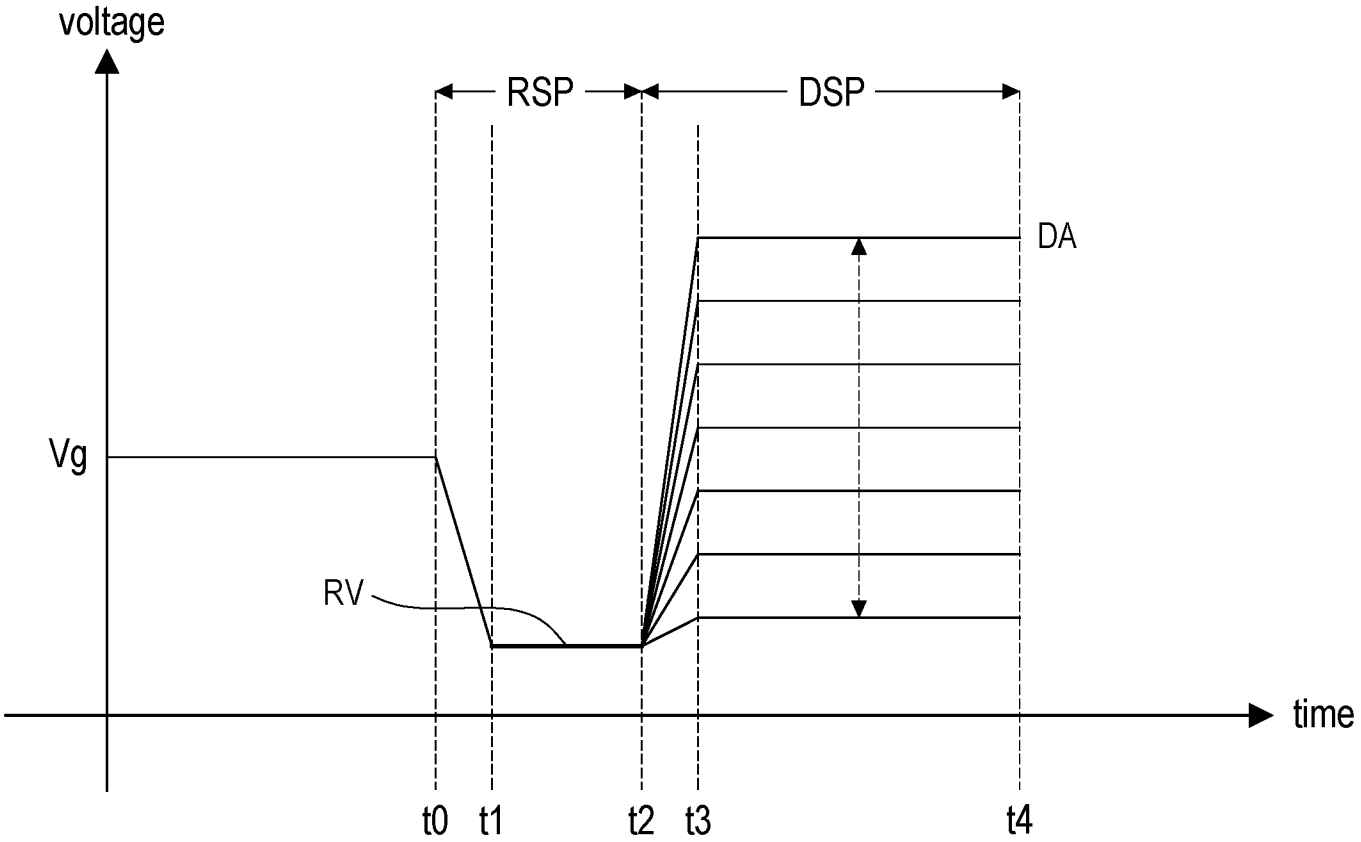
FIG. 5 is schematic diagram of a voltage of the control terminal of the second transistor according to another embodiment of the disclosure.

FIG. 5 is schematic diagram of a voltage of the control terminal of the second transistor according to another embodiment of the disclosure. Referring to FIG. 4 and FIG. 5, the voltage change of the voltage Vg of the control terminal (gate terminal) of the second transistor T2 may be implemented as shown in FIG. 5. In the embodiment of the disclosure, before to time t0, the data line DS may transmit a data voltage of a previously frame. During a reset scan period RSP from time t0 to time t1, the voltage Vg of the control terminal of the second transistor T2 may drop to a reset voltage RV to generate the reset signal. During the reset scan period RSP from time t1 to time t2, the reset signal is maintained at the reset voltage RV. During a data scan period DSP from time t2 to time t3, the voltage Vg of the control terminal of the second transistor T2 may rise to a data voltage DA to generate the data signal. The data voltage DA may be selected from a specific voltage range. During the data scan period DSP from time t3 to time t4, the voltage Vg of the control terminal of the second transistor T2 is maintained at the data voltage DA.

In the embodiment of the disclosure, due to the data signals respectively having different data voltages may be transmitted to the control terminal of the second transistor in adjacent data scan periods (or adjacent frame periods), such as the data scan period before to time t0 and the data scan period DSP from time t3 to time t4, the reset voltage RV of the reset signal may be determined to be less than or equal to the data voltage DA of the data signal to reset the voltage (i.e. a gate-source voltage Vgs) between the control terminal (gate terminal) and the first terminal (source terminal) of the second transistor T2, so as to reduce or eliminate the hysteretic characteristics of the second transistor T2 due to the sweep voltage (Vgs) of the second transistor T2.

In the embodiment of the disclosure, the reset voltage RV of the reset signal may be less than or equal to a voltage of the first terminal (source terminal) of the second transistor T2. In other embodiments of the disclosure, the reset voltage RV of the reset signal may be less than or equal to a lowest data voltage of the data signal. In other embodiments of the disclosure, the reset voltage RV of the reset signal may be less than or equal to the second operation voltage PVSS.

Figure 6:
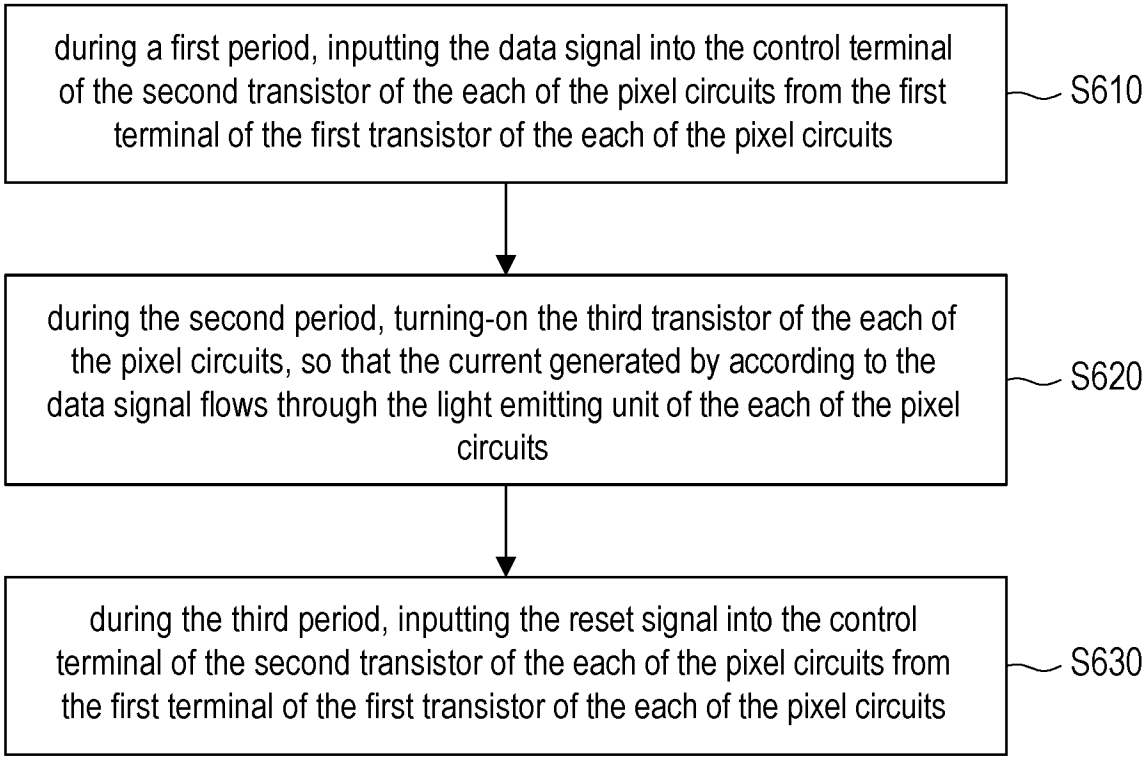
FIG. 6 is a flow chart of a method for driving an active-matrix pixel array according to an embodiment of the disclosure.

FIG. 6 is a flow chart of a method for driving an active-matrix pixel array according to an embodiment of the disclosure. Referring to FIG. 1 and FIG. 6, the active-matrix pixel array 100A may execute the following steps S610 to S630 to achieve efficient driving operations, but the order of execution of the steps S610 to S630 is not limited to the order shown in FIG. 6. In step S610, during a first period (e.g. the data scan period DSP of FIG. 3 or FIG. 5), inputting a data signal into the control terminal of the second transistor (e.g. the second transistor T2 of FIG. 2 or FIG. 4) of the each of the pixel circuits 110(1,1) to 110(*m,n*) from a first terminal of the first transistor (e.g. the first transistor T1 of FIG. 2 or FIG. 4) of the each of the pixel circuits 110(1,1) to 110(*m,n*). In step S620, during a second period, turning-on the third transistor (e.g. the third transistor T3 of FIG. 2 or FIG. 4) of the each of the pixel circuits 110(1,1) to 110(*m,n*), so that a current generated by according to the data signal flows through the light emitting unit (e.g. the light emitting unit 211 of FIG. 2 or the light emitting unit 411 of FIG. 4) of the each of the pixel circuits 110(1,1) to 110(*m,n*). In step S630, during a third period (e.g. the reset scan period RSP of FIG. 3 or FIG. 5), inputting a reset signal into the control terminal of the second transistor (e.g. the second transistor T2 of FIG. 2 or FIG. 4) of the each of the pixel circuits 110(1,1) to 110(*m,n*) from the first terminal of the first transistor (e.g. the first transistor T1 of FIG. 2 or FIG. 4) of the each of the pixel circuits 110(1,1) to 110(*m,n*). The reset signal has a first voltage (e.g. the reset voltage RV of FIG. 3 or FIG. 5). Therefore, the active-matrix pixel array 100A may effectively reduce or eliminate the hysteretic characteristics of the second transistor.

Figure 7:
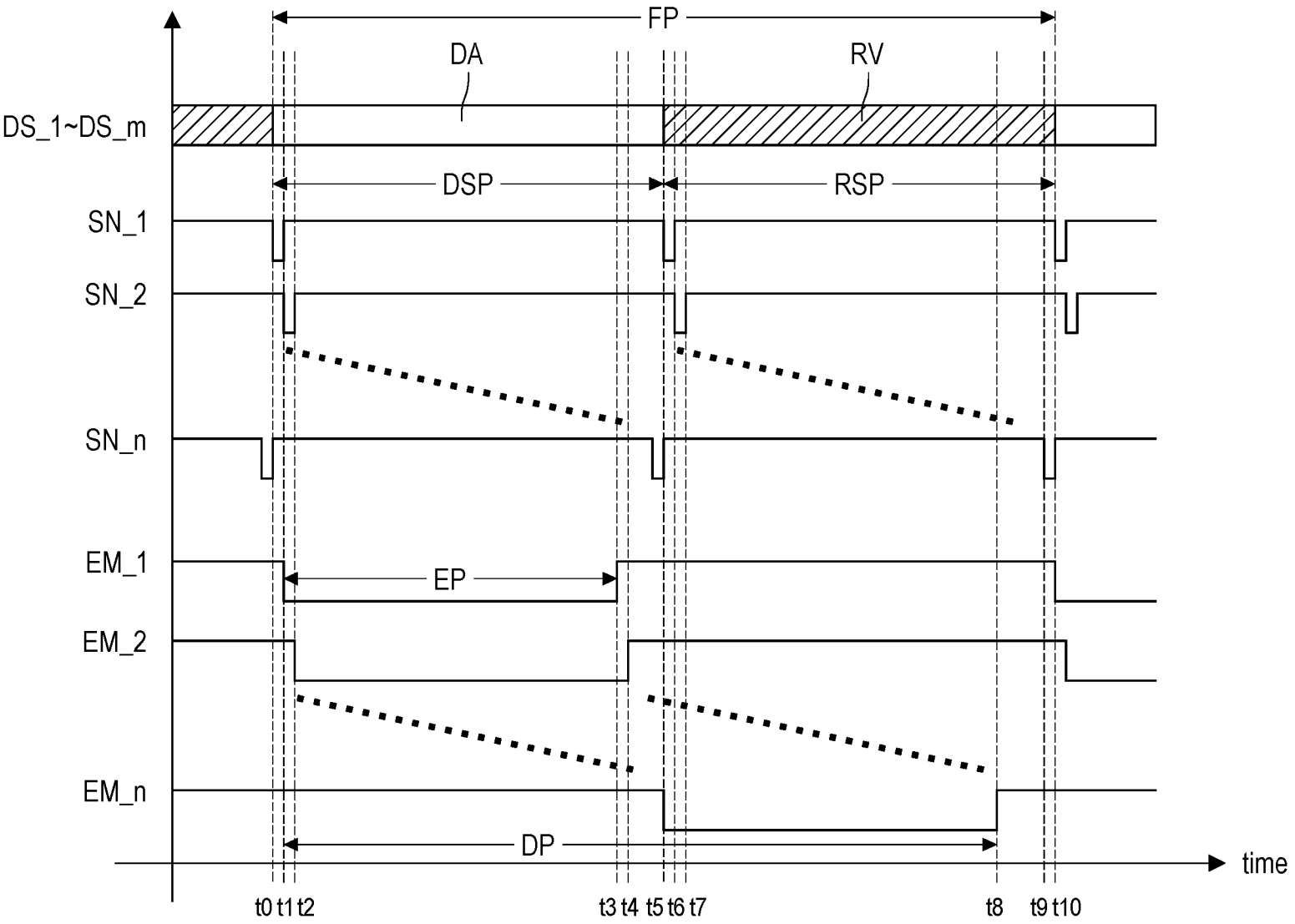
FIG. 7 is a timing diagram of related signals of the active-matrix pixel array according to a first embodiment of the disclosure.

FIG. 7 is a timing diagram of related signals of the active-matrix pixel array according to a first embodiment of the disclosure. Referring to FIG. 1, FIG. 2 and FIG. 7, the active-matrix pixel array 100A may be operated according to timing of the related signals as shown in FIG. 7, and each one of the pixel circuits 110(1,1) to 110(*m,n*) may be implemented as the pixel circuit 210 of FIG. 2 (P-type). In the embodiment of the disclosure, the data providing circuit 120 may be coupled to the each column of the pixel circuits 110(1,1) to 110(*m,n*) through the plurality of data lines DS_1 to DS_m, and the data providing circuit 120 may provide a data signal and a reset signal to the each one of the pixel circuits 110(1,1) to 110(*m,n*). The driving circuit 130 may be coupled to the each row of the pixel circuits 110(1,1) to 110(*m,n*) through the plurality of scan lines, and the driving circuit 130 may provide a scan signal to the each row of the pixel circuits 110(1,1) to 110(*m,n*) through the scan lines. The driving circuit 130 may be further coupled to the each row of the pixel circuits 110(1,1) to 110(*m,n*) through the plurality of control lines, and the driving circuit 130 may provide an emission signal to the each row of the pixel circuits 110(1,1) to 110(*m,n*) through the control lines.

During a data scan period DSP (that is, a first period recited in claim) from time t0 to time t5, the data providing circuit 120 may provide the data signal having the data voltage DA to the each column of the pixel circuits 110(1,1) to 110(*m,n*). The pixel circuits 110(1,1) to 110(*m,n*) coupled to different data lines DS_1 to DS_m may simultaneously receive the data signal having the data voltage DA during the data scan period DSP. The second transistors of different rows of the pixel circuits 110(1,1) to 110(*m*,*n*) respectively receive the data signal at different times of the data scan period DSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) transmits the data signal, and input the data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The data voltage DA of the data signal may be stored into a capacitor (e.g. the capacitor C1 of FIG. 2) of the each of the pixel circuits 110(1,1) to 110(*m*,*n*).

During a display period DP (that is, a second period recited in claim) from time t1 to time t8, the driving circuit 130 may respectively provide the emission signals EM_1 to EM_n to the pixel circuits 110(1,1) to 110(*m*,*n*) through the control lines at different times. The emission signals EM_1 to EM_n may be the low voltage level, so as to turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be driven by the current flowing through the light emitting unit of the each of the pixel circuits. The current is generated by the second transistor of the each of the pixel circuits 110(1,1) to 110(*m*,*n*) according to the data voltage DA of the data signal stored in the capacitor of the each of the pixel circuits 110(1,1) to 110(*m*,*n*).

For example, during the data scan period DSP, the driving circuit 130 may provide the scan signal SN_1 with a low voltage level to the scan line from time t0 to time t1, so as to turn-on the first transistor of the first row of the pixel circuits 110(1,1) to 110(*m*,*n*) for storing the data voltage DA of the data signal into the capacitor of the first row of the pixel circuits 110(1,1) to 110(*m*,*n*). Then, the driving circuit 130 may provide the emission signal EM_1 with the low voltage level to the control line from time t1 to time t3, so as to turn-on the third transistor of the first row of the pixel circuits 110(1,1) to 110(*m*,*n*). Thus, each light emitting unit of the first row of the pixel circuits 110(1,1) to 110(*m*,*n*) can be driven according to the data voltage DA during an emission period EP form time t1 to time t3. The driving circuit 130 may provide the scan signal SN_2 with the low voltage level to the scan line from time t1 to time t2, so as to turn-on the first transistor of the second row of the pixel circuits 110(1,1) to 110(*m*,*n*) for storing the data voltage DA of the data signal into the capacitor of the second row of the pixel circuits 110(1,1) to 110(*m*,*n*). Then, the driving circuit 130 may provide the emission signal EM_2 with the low voltage level to the control line from time t2 to time t4, so as to turn-on the third transistor of the second row of the pixel circuits 110(1,1) to 110(*m*,*n*). Thus, each light emitting unit of the second row of the pixel circuits 110(1,1) to 110(*m*,*n*) can be driven according to the data voltage DA during another emission period form time t2 to time t4. The driving manner of n row of the pixel circuits 110(1,1) to 110(*m*,*n*) can be deduced in the same way. Thus, each light emitting unit of the n row of the pixel circuits 110(1,1) to 110(*m*,*n*) can be driven during an emission period EP form time t5 to time t8.

During a reset scan period RSP (that is, a third period recited in claim) from time t5 to time t10, the data providing circuit 120 may provide the reset signal having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the reset signal having the reset voltage RV during the reset scan period RSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be the low voltage level, so as to turn-on a first transistor (e.g. the first transistor T1 of FIG. 2) of each of the pixel circuits 110(1,1) to 110(*m*,*n*). The second transistors of the different rows of the pixel circuits 110(1,1) to 110(*m*,*n*) respectively receive the reset signal at different times of the reset scan period RSP. Thus, the first transistor of the each of the pixel circuits 110(1,1) to 110(*m*,*n*) transmits the reset signal, and input the reset signal into the control terminal of the second transistor (e.g. the second transistor T2 of FIG. 2) of the each of the pixel circuits 110(1,1) to 110(*m*,*n*) from the first terminal of the first transistor of the each of the pixel circuits 110(1,1) to 110(*m*,*n*). The reset voltage RV of the reset signal may be reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames.

For example, during the data scan period DSP, the driving circuit 130 may provide the scan signals SN_1 with the low voltage level to the scan line from time t5 to time t6, so as to turn-on each first transistor of the first row of the pixel circuits 110(1,1) to 110(*m*,*n*) for transmitting the reset voltage RV to each second transistor of the first row of the pixel circuits 110(1,1) to 110(*m*,*n*). Thus, the each second transistor of the first row of the pixel circuits 110(1,1) to 110(*m*,*n*) can be reset during form time t5 to time t6. Then, the driving circuit 130 may provide the scan signal SN_2 with the low voltage level to the scan line from time t6 to time t7, so as to turn-on each first transistor of the second row of the pixel circuits 110(1,1) to 110(*m*,*n*) for transmitting the reset voltage RV to each second transistor of the second row of the pixel circuits 110(1,1) to 110(*m*,*n*). Thus, the each second transistor of the second row of the pixel circuits 110(1,1) to 110(*m*,*n*) can be reset during form time t6 to time t7. The reset manner of the n row of the pixel circuits 110(1,1) to 110(*m*,*n*) can be deduced in the same way.

In the embodiment of the disclosure, the reset scan period RSP continues the data scan period DSP, and the display period DP overlaps the reset scan period RSP and the data scan period DSP. Furthermore, a time length of one frame period FP may equal to or greater than a sum of time lengths of the data scan period DSP and the reset scan period RSP. In one embodiment of the disclosure, there may be a blanking period between the data scan period DSP and the reset scan period RSP.

Figure 8:
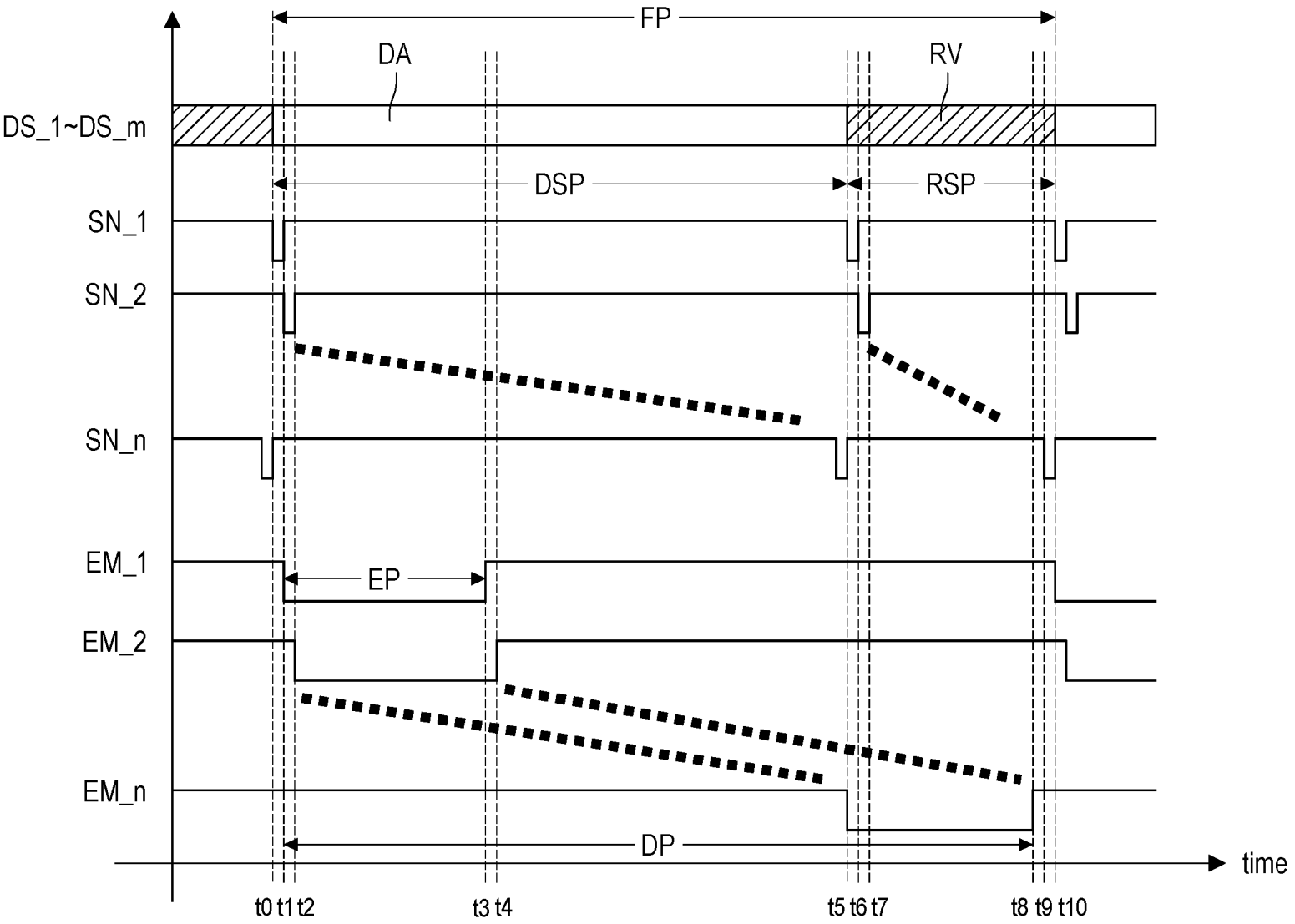
FIG. 8 is a timing diagram of related signals of the active-matrix pixel array according to a second embodiment of the disclosure.

FIG. 8 is a timing diagram of related signals of the active-matrix pixel array according to a second embodiment of the disclosure. Referring to FIG. 1, FIG. 2 and FIG. 8, the active-matrix pixel array 100A may be operated according to timing of the related signals as shown in FIG. 8, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the third period continues the first period, and a time length of the reset scan period RSP is shorter than a time length of the data scan period DSP. In addition, the driving manner and the reset manner of the embodiment of FIG. 8 may refer the above-mentioned embodiment of FIG. 7, and details are not described herein again.

Figure 9:
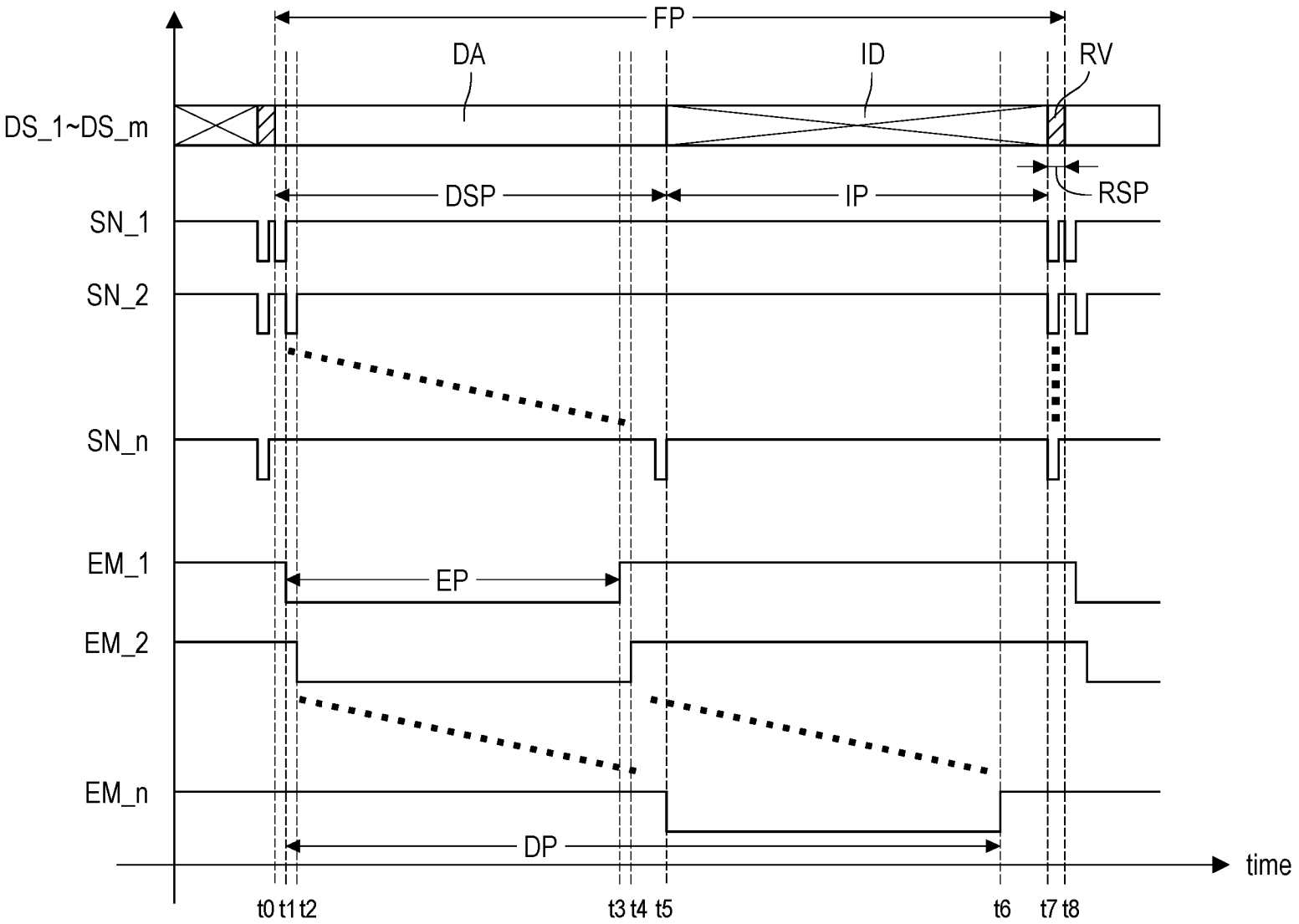
FIG. 9 is a timing diagram of related signals of the active-matrix pixel array according to a third embodiment of the disclosure.

FIG. 9 is a timing diagram of related signals of the active-matrix pixel array according to a third embodiment of the disclosure. Referring to FIG. 1, FIG. 2 and FIG. 9, the active-matrix pixel array 100A may be operated according to timing of the related signals as shown in FIG. 9, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the reset scan period RSP is later than the data scan period DSP, and there is an invalid period IP (that is, a fourth period recited in claim) between the reset scan period RSP and the data scan period DSP.

During a data scan period DSP (that is, a first period recited in claim) from time t0 to time t5, the data providing circuit 120 may provide the data signal having the data voltage DA to the each column of the pixel circuits 110(1,1) to 110(*m*,*n*). The pixel circuits 110(1,1) to 110(*m*,*n*) coupled to different data lines DS_1 to DS_m may simultaneously receive the data signal having the data voltage DA during the data scan period DSP. The second transistors of different rows of the pixel circuits 110(1,1) to 110(*m*,*n*) respectively receive the data signal at different times of the data scan period DSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) transmits the data signal, and input the data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The data voltage DA of the data signal may be stored into a capacitor (e.g. the capacitor C1 of FIG. 2) of the each of the pixel circuits 110(1,1) to 110(*m*,*n*).

During a display period DP (that is, a second period recited in claim) from time t1 to time t6, the driving circuit 130 may respectively provide the emission signals EM_1 to EM_n to the pixel circuits 110(1,1) to 110(*m*,*n*) through the control lines at different times. The emission signals EM_1 to EM_n may be the low voltage level, so as to turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be driven by the current flowing through the light emitting unit of the each of the pixel circuits. The current is generated by the second transistor of the each of the pixel circuits 110(1,1) to 110(*m*,*n*) according to the data voltage DA of the data signal stored in the capacitor of the each of the pixel circuits 110(1,1) to 110(*m*,*n*).

During the invalid period IP (that is, a fourth period recited in claim) from time t5 to time t7, the symbol ID may represent that the data providing circuit 120 does not need to provide data to the first transistor of the each column of the pixel circuits 110(1,1) to 110(*m*,*n*), so that all pixel circuits wait to finish the display period DP of the last row (n th row) of the pixel circuits 110(1,1) to 110(*m*,*n*) before starting a reset period RSP. Moreover, the driving circuit 130 may finish providing the scan signal before time t5 and may continuously provide the emission signal until time t6.

For example, during the data scan period DSP, the driving circuit 130 may provide the scan signal SN_1 with a low voltage level to the scan line from time t0 to time t1, so as to turn-on the first transistor of the first row of the pixel circuits 110(1,1) to 110(*m*,*n*) for storing the data voltage DA of the data signal into the capacitor of the first row of the pixel circuits 110(1,1) to 110(*m*,*n*). Then, the driving circuit 130 may provide the emission signal EM_1 with the low voltage level to the control line from time t1 to time t3, so as to turn-on the third transistor of the first row of the pixel circuits 110(1,1) to 110(*m*,*n*). Thus, each light emitting unit of the first row of the pixel circuits 110(1,1) to 110(*m*,*n*) can be driven according to the data voltage DA during an emission period EP form time t1 to time t3. The driving circuit 130 may provide the scan signal SN_2 with the low voltage level to the scan line from time t1 to time t2, so as to turn-on the first transistor of the second row of the pixel circuits 110(1,1) to 110(*m*,*n*) for storing the data voltage DA of the data signal into the capacitor of the second row of the pixel circuits 110(1,1) to 110(*m*,*n*). Then, the driving circuit 130 may provide the emission signal EM_2 with the low voltage level to the control line from time t2 to time t4, so as to turn-on the third transistor of the second row of the pixel circuits 110(1,1) to 110(*m*,*n*). Thus, each light emitting unit of the second row of the pixel circuits 110(1,1) to 110(*m*,*n*) can be driven according to the data voltage DA during another emission period form time t2 to time t4. The driving manner of n row of the pixel circuits 110(1,1) to 110(*m*,*n*) can be deduced in the same way. Thus, each light emitting unit of the n row of the pixel circuits 110(1,1) to 110(*m*,*n*) can be driven during the emission period form time t5 to time t6.

During the reset scan period RSP (that is, a third period recited in claim) from time t7 to time t8, the data providing circuit 120 may provide the reset signal having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the reset signal having the reset voltage RV during the reset scan period RSP. Moreover, the driving circuit 130 may simultaneously provide the scan signals SN_1 to SN_n to the pixel circuits 110(1,1) to 110(*m*,*n*) through the scan lines. The scan signal may be the low voltage level, so as to turn-on a first transistor (e.g. the first transistor T1 of FIG. 2) of each of the pixel circuits 110(1,1) to 110(*m*,*n*). The second transistors of the different rows of the pixel circuits 110(1,1) to 110(*m*,*n*) simultaneously receive the reset signal during the reset scan period RSP. Thus, the first transistor of the each of the pixel circuits 110(1,1) to 110(*m*,*n*) transmits the reset signal, and input the reset signal into the control terminal of the second transistor (e.g. the second transistor T2 of FIG. 2) of the each of the pixel circuits 110(1,1) to 110(*m*,*n*) from the first terminal of the first transistor of the each of the pixel circuits 110(1,1) to 110(*m*,*n*). The reset voltage RV of the reset signal may be reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames.

For example, during the reset scan period RSP, the driving circuit 130 may provide the scan signals SN_1 to SN_n with the low voltage level to all of the scan lines from time t7 to time t8. Thus, all second transistor of the pixel circuits 110(1,1) to 110(*m*,*n*) can be simultaneously reset during form time t7 to time t8.

In the embodiment of the disclosure, the display period DP overlaps the data scan period DSP and the invalid period IP. Furthermore, a time length of one frame period FP may equal to or greater than a sum of time lengths of the data scan period DSP, the invalid period IP and the reset scan period RSP.

Figure 10:
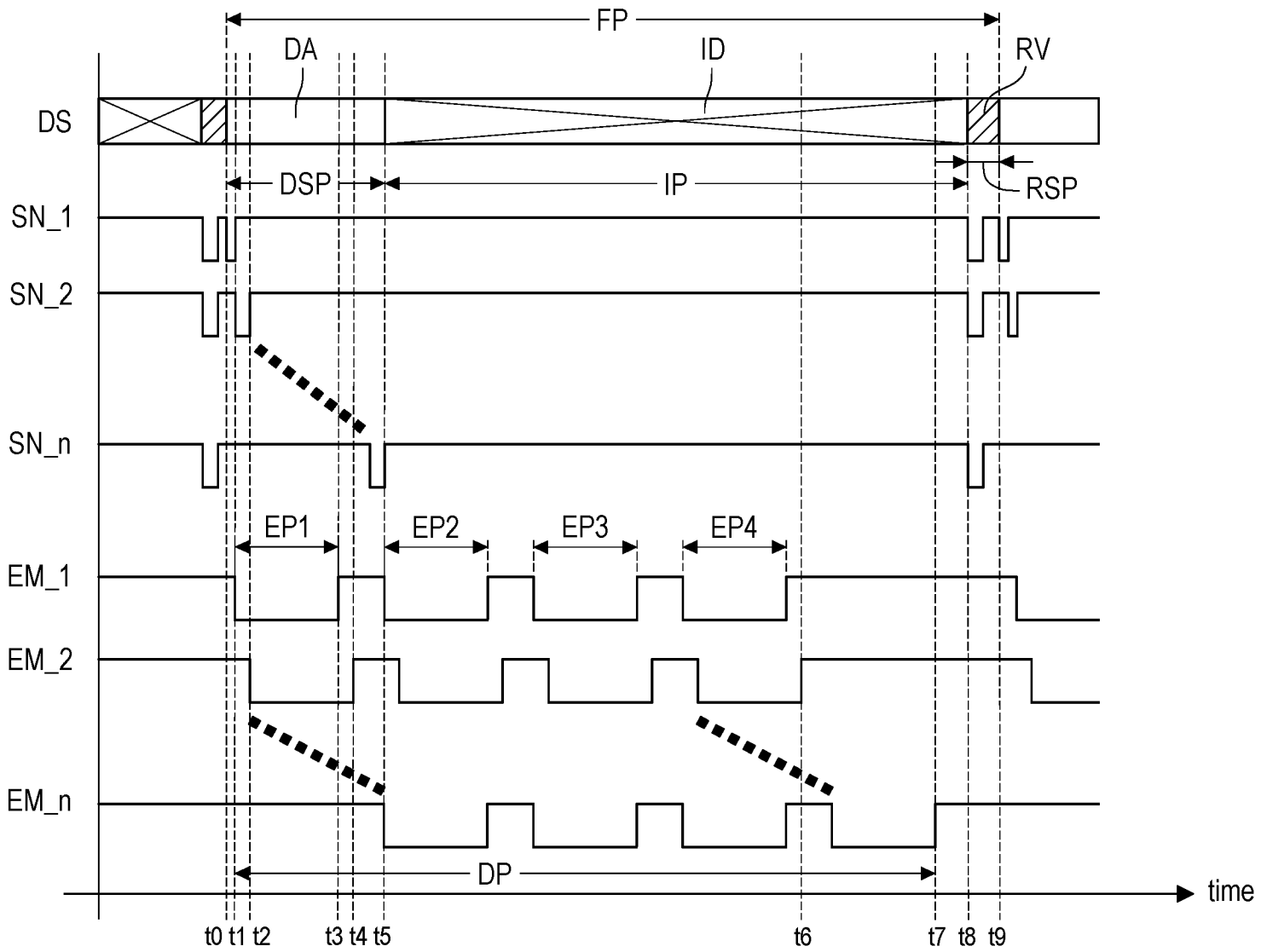
FIG. 10 is a timing diagram of related signals of the active-matrix pixel array according to a fourth embodiment of the disclosure.

FIG. 10 is a timing diagram of related signals of the active-matrix pixel array according to a fourth embodiment of the disclosure. Referring to FIG. 1, FIG. 2 and FIG. 10, the active-matrix pixel array 100A may be operated according to timing of the related signals as shown in FIG. 10, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the reset scan period RSP is later than the data scan period DSP, and there is an invalid period IP (that is, a fourth period recited in claim) between the reset scan period RSP and the data scan period DSP. Moreover, the emission period is divided into a plurality of sub-emission periods EP1 to EP4 (that is, the second sub-periods recited in claim).

During a data scan period DSP (that is, a first period recited in claim) from time t0 to time t5, the data providing circuit 120 may provide the data signal having the data voltage DA to the each column of the pixel circuits 110(1,1) to 110(*m*,*n*). The pixel circuits 110(1,1) to 110(*m*,*n*) coupled to different data lines DS_1 to DS_m may simultaneously receive the data signal having the data voltage DA during the data scan period DSP. The second transistors of different rows of the pixel circuits 110(1,1) to 110(*m*,*n*) respectively receive the data signal at different times of the data scan period DSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) transmits the data signal, and input the data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The data voltage DA of the data signal may be stored into a capacitor (e.g. the capacitor C1 of FIG. 2) of the each of the pixel circuits 110(1,1) to 110(*m*,*n*).

During a display period DP (that is, a second period recited in claim) from time t1 to time t7, the driving circuit 130 may respectively provide the emission signals having a plurality of sub-emission signals to the pixel circuits 110(1,1) to 110(*m*,*n*) through the control lines at different times. The plurality of sub-emission signals may be a plurality of non-consecutive low voltage levels, so as to periodically turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be periodically driven by the currents flowing through the light emitting unit of the each of the pixel circuits. The current is periodically generated by the second transistor of the each of the pixel circuits 110(1,1) to 110(*m*,*n*) according to the data voltage DA of the data signal stored in the capacitor of the each of the pixel circuits 110(1,1) to 110(*m*,*n*).

During the invalid period IP (that is, a fourth period recited in claim) from time t5 to time t8, the symbol ID may represent that the data providing circuit 120 does not need to provide data to the first transistor of the each column of the pixel circuits 110(1,1) to 110(*m*,*n*), so that all pixel circuits wait to finish the display period DP of the last row (n th row) of the pixel circuits 110(1,1) to 110(*m*,*n*) before starting a reset scan period RSP. Moreover, the driving circuit 130 may finish providing the scan signal before time t5 and may continuously provide the emission signal until time t8.

For example, during the data scan period DSP, the driving circuit 130 may provide the scan signal SN_1 with a low voltage level to the scan line from time t0 to time t1, so as to turn-on the first transistor of the first row of the pixel circuits 110(1,1) to 110(*m*,*n*) for storing the data voltage DA of the data signal into the capacitor of the first row of the pixel circuits 110(1,1) to 110(*m*,*n*). Then, the driving circuit 130 may provide the emission signal EM_1 having the plurality of non-consecutive low voltage levels as the plurality of sub-emission signals to the control line from time t1 to time t7, so as to periodically turn-on the third transistor of the first row of the pixel circuits 110(1,1) to 110(*m*,*n*). Thus, each light emitting unit of the first row of the pixel circuits 110(1,1) to 110(*m*,*n*) can be periodically driven according to the data voltage DA during the plurality of sub-emission periods EP1 to EP4 form time t1 to time t7. The driving circuit 130 may provide the scan signal SN_2 with the low voltage level to the scan line from time t1 to time t2, so as to turn-on the first transistor of the second row of the pixel circuits 110(1,1) to 110(*m*,*n*) for storing the data voltage DA of the data signal into the capacitor of the second row of the pixel circuits 110(1,1) to 110(*m*,*n*). Then, the driving circuit 130 may provide the emission signal EM_2 having the plurality of non-consecutive low voltage levels as another plurality of sub-emission signals to the control line from time t2 to time t6, so as to turn-on the third transistor of the first row of the pixel circuits 110(1,1) to 110(*m*,*n*). Thus, each light emitting unit of the second row of the pixel circuits 110(1,1) to 110(*m*,*n*) can be periodically driven according to the data voltage DA during the another plurality of sub-emission periods form time t2 to time t6. The driving manner of n row of the pixel circuits 110(1,1) to 110(*m*,*n*) can be deduced in the same way. Thus, each light emitting unit of the n row of the pixel circuits 110(1,1) to 110(*m*,*n*) can be periodically driven during the emission period form time t5 to time t7.

During the reset scan period RSP (that is, a third period recited in claim) from time t8 to time t9, the data providing circuit 120 may provide the reset signal having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the reset signal having the reset voltage RV during the reset scan period RSP. Moreover, the driving circuit 130 may simultaneously provide the scan signals SN_1 to SN_n to the pixel circuits 110(1,1) to 110(*m*,*n*) through the scan lines. The scan signal may be the low voltage level, so as to turn-on a first transistor (e.g. the first transistor T1 of FIG. 2) of each of the pixel circuits 110(1,1) to 110(*m*,*n*). The second transistors of the different rows of the pixel circuits 110(1,1) to 110(*m*,*n*) simultaneously receive the reset signal during the reset scan period RSP. Thus, the first transistor of the each of the pixel circuits 110(1,1) to 110(*m*,*n*) transmits the reset signal, and input the reset signal into the control terminal of the second transistor (e.g. the second transistor T2 of FIG. 2) of the each of the pixel circuits 110(1,1) to 110(*m*,*n*) from the first terminal of the first transistor of the each of the pixel circuits 110(1,1) to 110(*m*,*n*). The reset voltage RV of the reset signal may be reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames.

For example, during the reset scan period RSP, the driving circuit 130 may provide the scan signals SN_1 to SN_n with the low voltage level to all of the scan lines from time t8 to time t9. Thus, all second transistor of the pixel circuits 110(1,1) to 110(*m*,*n*) can be simultaneously reset during form time t8 to time t9.

In the embodiment of the disclosure, the display period DP overlaps the data scan period DSP and the invalid period IP. Furthermore, a time length of one frame period FP may equal to or greater than a sum of time lengths of the data scan period DSP, the invalid period IP and the reset scan period RSP.

Figure 11:
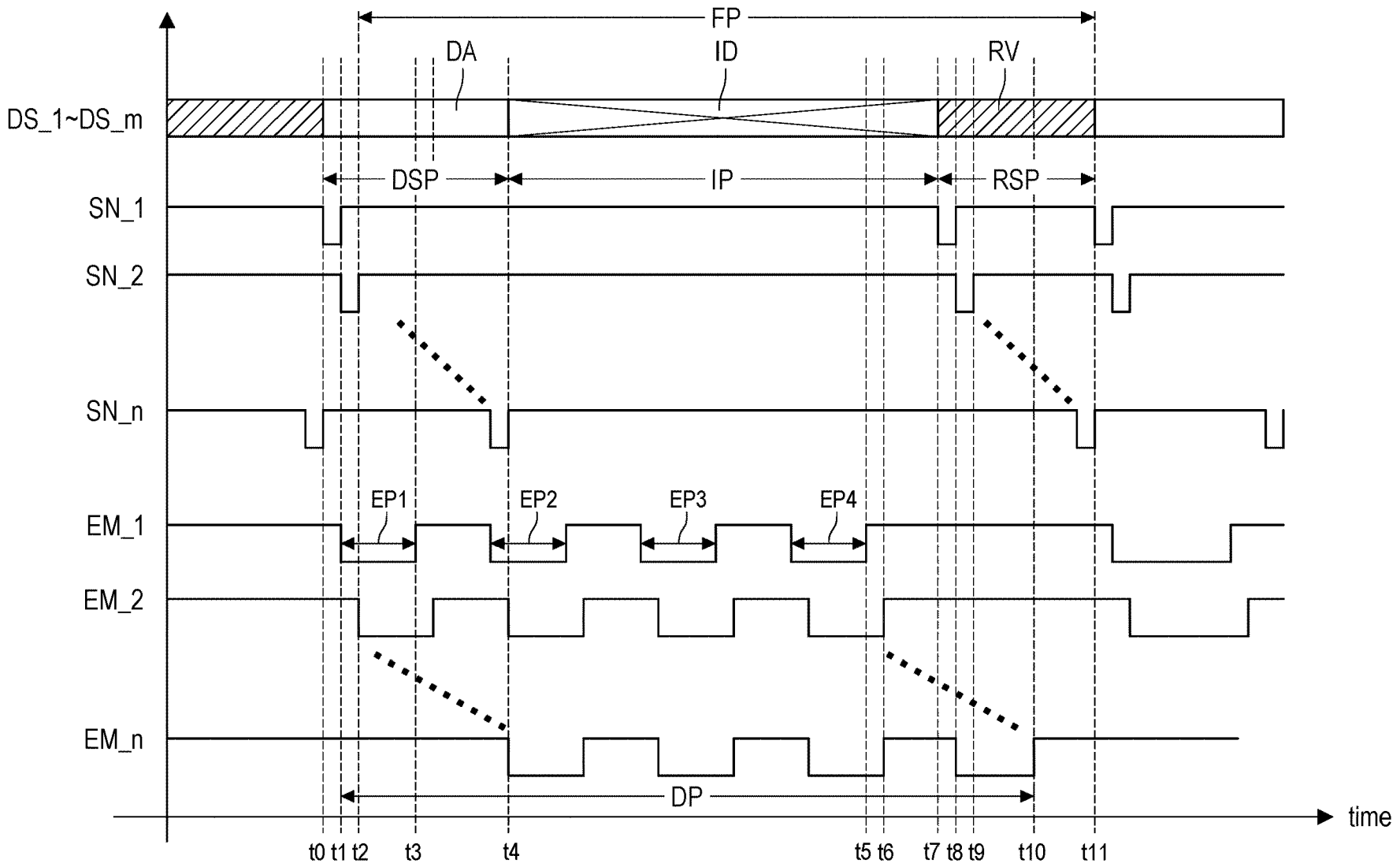
FIG. 11 is a timing diagram of related signals of the active-matrix pixel array according to a fifth embodiment of the disclosure.

FIG. 11 is a timing diagram of related signals of the active-matrix pixel array according to a fifth embodiment of the disclosure. Referring to FIG. 1, FIG. 2 and FIG. 11, the active-matrix pixel array 100A may be operated according to timing of the related signals as shown in FIG. 11, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the reset scan period RSP is later than the data scan period DSP, and there is an invalid period IP (that is, a fifth period recited in claim) between the reset scan period RSP and the data scan period DSP. Moreover, the emission period is divided into a plurality of sub-emission periods EP1 to EP4 (that is, the second sub-periods recited in claim).

During a data scan period DSP (that is, a first period recited in claim) from time t0 to time t4, the data providing circuit 120 may provide the data signal having the data voltage DA to the each column of the pixel circuits 110(1,1) to 110(*m*,*n*). The pixel circuits 110(1,1) to 110(*m*,*n*) coupled to different data lines DS_1 to DS_m may simultaneously receive the data signal having the data voltage DA during the data scan period DSP. The second transistors of different rows of the pixel circuits 110(1,1) to 110(*m*,*n*) respectively receive the data signal at different times of the data scan period DSP. Moreover, the driving circuit 130 may respectively provide the scan signals SN_1 to SN_n to the pixel circuits 110(1,1) to 110(*m*,*n*) through the scan lines at different times. The scan signal may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) transmits the data signal, and input the data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The data voltage DA of the data signal may be stored into a capacitor (e.g. the capacitor C1 of FIG. 2) of the each of the pixel circuits 110(1,1) to 110(*m*,*n*).

During a display period DP (that is, a second period recited in claim) from time t1 to time t10, the driving circuit 130 may respectively provide the emission signals having a plurality of sub-emission signals to the pixel circuits 110(1,1) to 110(*m*,*n*) through the control lines at different times. The plurality of sub-emission signals may be a plurality of non-consecutive low voltage levels, so as to periodically turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be periodically driven by the currents flowing through the light emitting unit of the each of the pixel circuits. The currents is periodically generated by the second transistor of the each of the pixel circuits 110(1,1) to 110(*m*,*n*) according to the data voltage DA of the data signal stored in the capacitor of the each of the pixel circuits 110(1,1) to 110(*m*,*n*).

During the invalid period IP (that is, a fourth period recited in claim) from time t4 to time t7, the symbol ID may represent that the data providing circuit 120 does not need to may provide data to the first transistor of the each column of the pixel circuits 110(1,1) to 110(*m*,*n*), so that all pixel circuits wait to finish the display period DP of the last row (n-th row) of the pixel circuits 110(1,1) to 110(*m*,*n*) before starting a reset period RSP. Moreover, the driving circuit 130 may finish providing the scan signal before time t4 and may continuously provide the emission signal until time t10.

For example, during the data scan period DSP, the driving circuit 130 may provide the scan signal SN_1 with the low voltage level to the scan line from time t0 to time t1, so as to turn-on each first transistor of the first row of the pixel circuits 110(1,1) to 110(*m*,*n*) for storing the data voltage DA of the data signal into the capacitor of the first row of the pixel circuits 110(1,1) to 110(*m*,*n*). Then, the driving circuit 130 may provide the emission signal EM_1 having the plurality of non-consecutive low voltage levels as the plurality of sub-emission signals to the control line from time t1 to time t5, so as to periodically turn-on the third transistor of the first row of the pixel circuits 110(1,1) to 110(*m*,*n*). Thus, each light emitting unit of the first row of the pixel circuits 110(1,1) to 110(*m*,*n*) can be periodically driven according to the data voltage DA during the plurality of sub-emission periods EP1 to EP4 form time t1 to time t5. The driving circuit 130 may provide the scan signal SN_2 with the low voltage level to the scan line from time t1 to time t2, so as to turn-on the first transistor of the second row of the pixel circuits 110(1,1) to 110(*m*,*n*) for storing the data voltage DA of the data signal into the capacitor of the second row of the pixel circuits 110(1,1) to 110(*m*,*n*). Then, the driving circuit 130 may provide the emission signal EM_2 having the plurality of non-consecutive low voltage levels as another plurality of sub-emission signals to the control line from time t2 to time t6, so as to turn-on the third transistor of the first row of the pixel circuits 110(1,1) to 110(*m*,*n*). Thus, each light emitting unit of the second row of the pixel circuits 110(1,1) to 110(*m*,*n*) can be periodically driven according to the data voltage DA during the another plurality of sub-emission periods form time t2 to time t6. The driving manner of n row of the pixel circuits 110(1,1) to 110(*m*,*n*) can be deduced in the same way. Thus, each light emitting unit of the n row of the pixel circuits 110(1,1) to 110(*m*,*n*) can be periodically driven during the emission period form time t4 to time t10.

During the reset scan period RSP (that is, a third period recited in claim) from time t7 to time t11, the data providing circuit 120 may provide the reset signal having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the reset signal having the reset voltage RV during the reset scan period RSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be the low voltage level, so as to turn-on a first transistor (e.g. the first transistor T1 of FIG. 2) of each of the pixel circuits 110(1,1) to 110(*m*,*n*). The second transistors of the different rows of the pixel circuits 110(1,1) to 110(*m*,*n*) respectively receive the reset signal at different times of the reset scan period RSP. Thus, the first transistor of the each of the pixel circuits 110(1,1) to 110(*m*,*n*) transmits the reset signal, and input the reset signal into the control terminal of the second transistor (e.g. the second transistor T2 of FIG. 2) of the each of the pixel circuits 110(1,1) to 110(*m*,*n*) from the first terminal of the first transistor of the each of the pixel circuits 110(1,1) to 110(*m*,*n*). The reset voltage RV of the reset signal may be reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames.

For example, during the reset scan period RSP, the driving circuit 130 may provide the scan signal SN_1 with the low voltage level to the scan line from time t7 to time t8, so as to turn-on each first transistor of the first row of the pixel circuits 110(1,1) to 110(*m*,*n*) for transmitting the reset voltage RV to each second transistor of the first row of the pixel circuits 110(1,1) to 110(*m*,*n*). Thus, each second transistor of the first row of the pixel circuits 110(1,1) to 110(*m*,*n*) can be reset during form time t7 to time t8. Then, the driving circuit 130 may provide the scan signal SN_2 with the low voltage level to the scan line from time t8 to time t9, so as to turn-on each first transistor of the second row of the pixel circuits 110(1,1) to 110(*m*,*n*) for transmitting the reset voltage RV to each second transistor of the second row of the pixel circuits 110(1,1) to 110(*m*,*n*). Thus, each second transistor of the second row of the pixel circuits 110(1,1) to 110(*m*,*n*) can be reset during form time t8 to time t9. The reset manner of the n row of the pixel circuits 110(1,1) to 110(*m*,*n*) can be deduced in the same way.

In the embodiment of the disclosure, a time length of the reset scan period RSP is shorter than a time length of the data scan period DSP. A time length of each of the plurality of sub-emission periods EM1 to EM4 is shorter than a time length of the reset scan period RSP. The display period DP overlaps the data scan period DSP, the invalid period IP and the reset scan period RSP. Furthermore, a time length of one frame period FP may equal to or greater than a sum of time lengths of the data scan period DSP, the invalid period IP and the reset scan period RSP.

Figure 12:
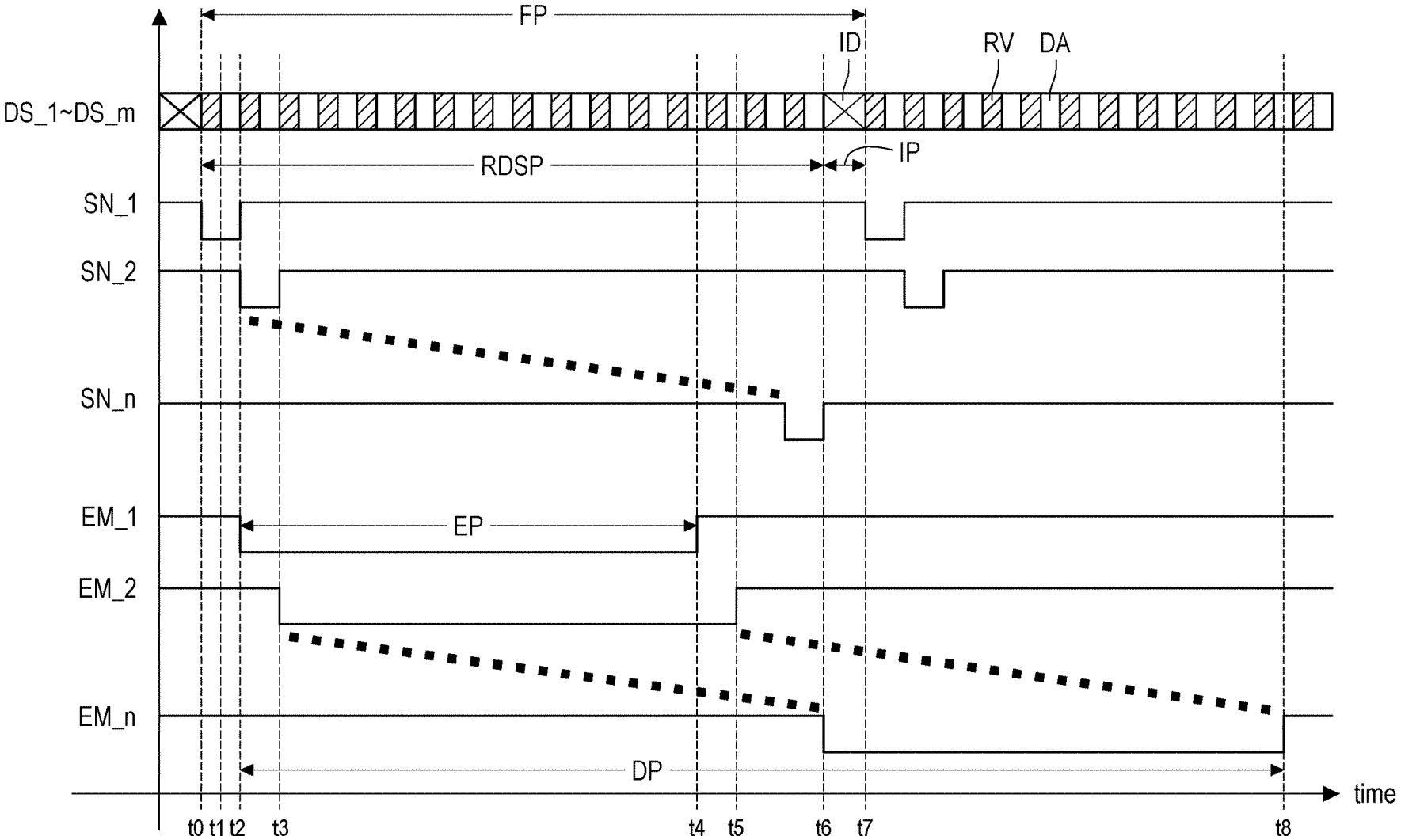
FIG. 12 is a timing diagram of related signals of the active-matrix pixel array according to a sixth embodiment of the disclosure.

FIG. 12 is a timing diagram of related signals of the active-matrix pixel array according to a sixth embodiment of the disclosure. Referring to FIG. 1, FIG. 2 and FIG. 12, the active-matrix pixel array 100A may be operated according to timing of the related signals as shown in FIG. 12, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the data scan period is divided into a plurality of sub data scan periods (that is, a plurality of first sub-periods recited in claim), and the reset scan period is divided into a plurality of sub reset scan periods (that is, a plurality of third sub-periods recited in claim). Each of the sub reset scan periods is earlier than each corresponding one of the sub data scan periods. Moreover, there is an invalid period IP (that is, a six period recited in claim) after a final sub data scan period. The sub data scan periods alternate with the sub reset scan periods to form a reset and scan period RDSP.

During the reset and scan period RDSP from time t0 to time t6, the data providing circuit 120 may alternately provide a plurality of data signals having the data voltage DA and plurality of reset signals having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the data signals and the reset signals during the reset and scan period RDSP. The second transistors of different rows of the pixel circuits 110(1,1) to 110(*m*,*n*) respectively receive the data signals and the reset signals at different times of the reset and scan period RDSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) continuously transmits the data signals and the reset signals, and continuously input the reset signal and data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The reset voltage RV of the reset signals may be firstly reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames. Then, the data voltage DA of the data signals may be stored into a capacitor (e.g. the capacitor C1 of FIG. 2) of the each of the pixel circuits 110(1,1) to 110(*m*,*n*).

During the invalid period IP (that is, a sixth period recited in claim) from time t6 to time t7, the symbol ID may represent that the data providing circuit 120 does not need to provide data to the first transistor of the each column of the pixel circuits 110(1,1) to 110(*m*,*n*), so that all pixel circuits wait to finish the display period DP of the last row (n th row) of the pixel circuits 110(1,1) to 110(*m*,*n*) before starting the reset period RSP. Moreover, the driving circuit 130 may finish providing the scan signal before time t5 and may continuously provide the emission signal until time t6.

During a display period DP (that is, a second period recited in claim) from time t2 to time t8, the driving circuit 130 may respectively provide an emission signals EM_1 to EM_n to the pixel circuits 110(1,1) to 110(*m*,*n*) through the control lines at different times. The emission signals EM_1 to EM_n may be the low voltage level, so as to turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be driven by the currents flowing through the light emitting unit of the each of the pixel circuits. The currents is generated by the second transistor of the each of the pixel circuits 110(1,1) to 110(*m*,*n*) according to the data voltage DA of the data signal stored in the capacitor of the each of the pixel circuits 110(1,1) to 110(*m*,*n*).

For example, during the reset and scan period RDSP, the driving circuit 130 may provide the scan signal SN_1 with the low voltage level to the scan line from time t0 to time t2, so as to turn-on each first transistor of the first row of the pixel circuits 110(1,1) to 110(*m*,*n*) for sequentially transmitting the reset voltage RV and the data voltage DA to each second transistor of the first row of the pixel circuits 110(1,1) to 110(*m*,*n*). Thus, each second transistor of the first row of the pixel circuits 110(1,1) to 110(*m*,*n*) can be reset firstly, and then driven according to the data voltage DA during the emission period EP form time t2 to time t4. Then, the driving circuit 130 may provide the scan signal SN_2 with the low voltage level to the scan line from time t2 to time t3, so as to turn-on each first transistor of the second row of the pixel circuits 110(1,1) to 110(*m*,*n*) for transmitting the reset voltage RV to each second transistor of the second row of the pixel circuits 110(1,1) to 110(*m*,*n*). Thus, each second transistor of the second row of the pixel circuits 110(1,1) to 110(*m*,*n*) can be reset firstly, and then driven according to the data voltage DA during the emission period form time t3 to time t5. The reset and driving manner of n row of the pixel circuits 110(1,1) to 110(*m*,*n*) can be deduced in the same way. Thus, each light emitting unit of the n row of the pixel circuits 110(1,1) to 110(*m*,*n*) can be driven during the emission period form time t6 to time t8.

In the embodiment of the disclosure, a time length of one frame period FP may equal to or greater than a sum of time lengths of the reset and scan period RDSP and the invalid period IP. The display period DP overlaps the reset and scan period RDSP and the invalid period IP.

Figure 13:
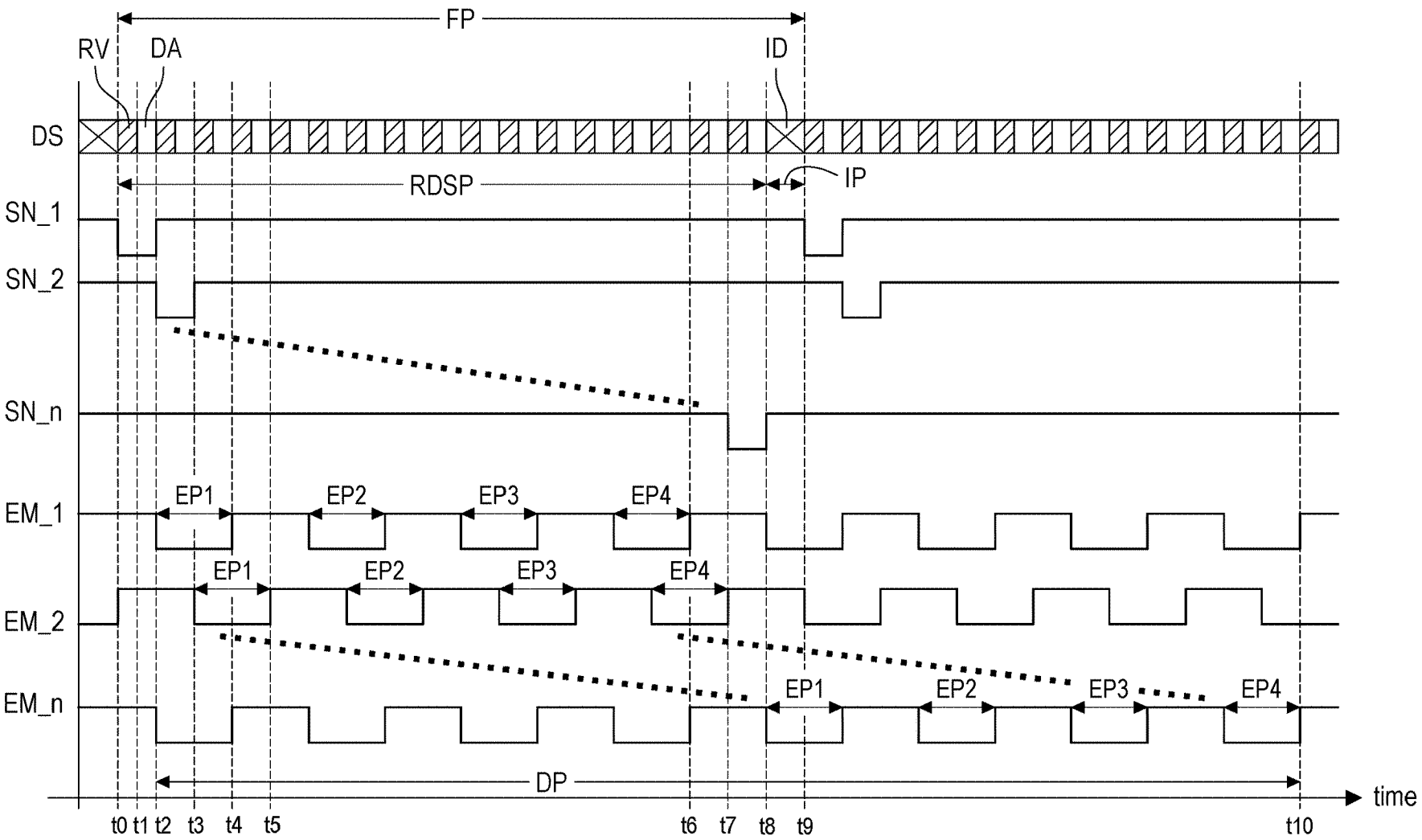
FIG. 13 is a timing diagram of related signals of the active-matrix pixel array according to a seventh embodiment of the disclosure.

FIG. 13 is a timing diagram of related signals of the active-matrix pixel array according to a seventh embodiment of the disclosure. Referring to FIG. 1, FIG. 2 and FIG. 13, the active-matrix pixel array 100A may be operated according to timing of the related signals as shown in FIG. 13, and each one of the pixel circuits 110(1,1) to 110(*m*,*n*) may be implemented as the pixel circuit 210 of FIG. 2 (P-type). Different from the embodiment of FIG. 7, in the embodiment of the disclosure, the data scan period is divided into a plurality of sub data scan periods (that is, a plurality of first sub-periods recited in claim), and the reset scan period is divided into a plurality of sub reset scan periods (that is, a plurality of third sub-periods recited in claim). Each of the sub reset scan periods is earlier than each corresponding one of the sub data scan periods. Moreover, there is an invalid period IP (that is, a six period recited in claim) after a final sub data scan period, and the emission period is divided into a plurality of sub-emission periods EP1 to EP4 (that is, the second sub-periods recited in claim). The sub data scan periods alternate with the sub reset scan periods to form a reset and scan period RDSP.

During the reset and scan period RDSP from time t0 to time t8, the data providing circuit 120 may alternately provide a plurality of data signals having the data voltage DA and plurality of reset signals having the reset voltage RV to the each column of the pixel circuits 110(1,1) to 110(*m*,*n*). The pixel circuits 110(1,1) to 110(*m*,*n*) coupled to different data lines DS_1 to DS_m may simultaneously receive the data signals and the reset signals during the reset and scan period RDSP. The second transistors of different rows of the pixel circuits 110(1,1) to 110(*m*,*n*) respectively receive the data signals and the reset signals at different times of the reset and scan period RDSP. Moreover, the driving circuit 130 may respectively provide the scan signals SN_1 to SN_n to the pixel circuits 110(1,1) to 110(*m*,*n*) through the scan lines at different times. The scan signals SN_1 to SN_n may be a low voltage level, so as to turn-on a first transistor (e.g. the first transistor T1 of FIG. 2) of each of the pixel circuits 110(1,1) to 110(*m*,*n*). Thus, the first transistor of the each of the pixel circuits 110(1,1) to 110(*m*,*n*) continuously transmits the data signals and the reset signals, and continuously input the reset signal and data signal into a control terminal of a second transistor (e.g. the second transistor T2 of FIG. 2) of the each of the pixel circuits 110(1,1) to 110(*m*,*n*) from a first terminal of the first transistor of the each of the pixel circuits 110(1,1) to 110(*m*,*n*). The reset voltage RV of the reset signals may be firstly reset the voltage (Vgs) between the control terminal (gate terminal) and the first terminal (source terminal) of the second transistor of the each of the pixel circuits 110(1,1) to 110(*m*,*n*), so as to reduce or eliminate the hysteretic characteristics of the second transistor of the each of the pixel circuits 110(1,1) to 110(*m*,*n*) due to the sweep voltage of the second transistor of the each of the pixel circuits 110(1,1) to 110(*m*,*n*) caused by the change of the data voltages between adjacent frames. Then, the data voltage DA of the data signals may be stored into a capacitor (e.g. the capacitor C1 of FIG. 2) of the each of the pixel circuits 110(1,1) to 110(*m*,*n*).

During the invalid period IP (that is, a sixth period recited in claim) from time t8 to time t9, the symbol ID may represent that the data providing circuit 120 does not need to provide data to the first transistor of the each column of the pixel circuits 110(1,1) to 110(*m*,*n*), so that all pixel circuits wait to finish the reset and scan period RDSP of the last row (n-th row) of the pixel circuits 110(1,1) to 110(*m*,*n*) before next reset and scan period. Moreover, the driving circuit 130 may finish providing the scan signal before time t8, and may continuously provide the emission signal until time t10.

During a display period DP (that is, a second period recited in claim) from time t2 to time t10, the driving circuit 130 may respectively provide an emission signals EM_1 to EM_n to the pixel circuits 110(1,1) to 110(*m*,*n*) through the control lines at different times. The emission signals EM_1 to EM_n may be the low voltage level, so as to turn-on a third transistor (e.g. the third transistor T3 of FIG. 2) of each of the pixel circuits 110(1,1) to 110(*m*,*n*). The third transistors of different rows of the pixel circuits 110(1,1) to 110(*m*,*n*) respectively receive the emission signal at different times of the display period DP. Thus, the light emitting unit (e.g. the light emitting unit 211 of FIG. 2) of each of the pixel circuits 110(1,1) to 110(*m*,*n*) can be driven by the currents flowing through the light emitting unit of the each of the pixel circuits. The currents is generated by the second transistor of the each of the pixel circuits 110(1,1) to 110(*m,n*) according to the data voltage DA of the data signal stored in the capacitor of the each of the pixel circuits 110(1,1) to 110(*m,n*).

For example, during the reset and scan period RDSP, the driving circuit 130 may provide the scan signal SN_1 with the low voltage level to the scan line from time t0 to time t2, so as to turn-on each first transistor of the first row of the pixel circuits 110(1,1) to 110(*m,n*) for sequentially transmitting the reset voltage RV and the data voltage DA to each second transistor of the first row of the pixel circuits 110(1,1) to 110(*m,n*). Then, the driving circuit 130 may provide the emission signal EM_1 having the plurality of non-consecutive low voltage levels as the plurality of sub-emission signals to the control line from time t2 to time t6, so as to periodically turn-on the third transistor of the first row of the pixel circuits 110(1,1) to 110(*m,n*). Thus, each second transistor of the first row of the pixel circuits 110(1,1) to 110(*m,n*) can be reset firstly according to the reset voltage RV, and then each light emitting unit of the first row of the pixel circuits 110(1,1) to 110(*m,n*) can be periodically driven according to the data voltage DA during the plurality of sub-emission periods EP1 to EP4 form time t2 to time t6. Then, the driving circuit 130 may provide the scan signal SN_2 with the low voltage level to the scan line from time t2 to time t3, so as to turn-on each first transistor of the second row of the pixel circuits 110(1,1) to 110(*m,n*) for transmitting the reset voltage RV and the data voltage DA to each second transistor of the second row of the pixel circuits 110(1,1) to 110(*m,n*). Thus, each second transistor of the second row of the pixel circuits 110(1,1) to 110(*m,n*) can be reset firstly, and then each light emitting unit of the second row of the pixel circuits 110(1,1) to 110(*m,n*) can be periodically driven according to the data voltage DA during the plurality of sub-emission periods form time t3 to time t7. The reset and driving manner of n row of the pixel circuits 110(1,1) to 110(*m,n*) can be deduced in the same way. Thus, each light emitting unit of the n row of the pixel circuits 110(1,1) to 110(*m,n*) can be driven during the emission period form time t8 to time t10.

In the embodiment of the disclosure, a time length of one frame period FP may equal to or greater than a sum of time lengths of the reset and scan period RDSP and the invalid period IP. The display period DP overlaps the reset and scan period RDSP and the invalid period IP.

In summary, the method for driving the active-matrix pixel array of the disclosure can effectively reset the voltage of between the gate terminal and the source terminal of the drive transistor (that is, the second transistor) of the each pixel circuit of the active-matrix pixel array frame by frame, so as to effectively reduce or eliminate the hysteretic characteristics of the drive transistor of the each pixel circuit of the active-matrix pixel array. Therefore, the image retention phenomenon of the display device using the active-matrix pixel array can be effectively improved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A method for driving an active-matrix pixel array, wherein the active-matrix pixel array comprises a plurality of pixel circuits, and each of the pixel circuits includes a first transistor, a second transistor, a third transistor and a light emitting unit, wherein the method comprises:

during a first period, inputting a data signal into a control terminal of the second transistor of the each of the pixel circuits from a first terminal of the first transistor of the each of the pixel circuits;

during a second period, turning-on the third transistor of the each of the pixel circuits, so that a current generated according to the data signal flows through the light emitting unit of the each of the pixel circuits; and during a third period, inputting a reset signal into the control terminal of the second transistor of the each of the pixel circuits from the first terminal of the first transistor of the each of the pixel circuits, wherein the reset signal has a first voltage, when the second transistor is a P-type transistor, the first voltage is greater than or equal to a voltage of a source terminal of the second transistor, when the second transistor is a N-type transistor, the first voltage is less than or equal to the voltage of a source terminal of the second transistor.

2. The method for driving the active-matrix pixel array according to the claim 1, wherein the third period continues the first period, and the second period overlaps the first period and the third period.

3. The method for driving the active-matrix pixel array according to the claim 1, wherein the third period continues the first period, and a time length of the third period is shorter than a time length of the first period.

4. The method for driving the active-matrix pixel array according to the claim 1, wherein second transistors of different rows of the pixel circuits respectively receive the data signal at different times of the first period.

5. The method for driving the active-matrix pixel array according to the claim 1, wherein second transistors of the different rows of the pixel circuits respectively receive the reset signal at different times of the third period.

6. The method for driving the active-matrix pixel array according to the claim 1, wherein third transistors of different rows of the pixel circuits respectively receive an emission signal at different times of the second period.

7. The method for driving the active-matrix pixel array according to the claim 1, wherein a time length of one frame period is equal to or greater than a sum of time lengths of the first period and the third period.

8. The method for driving the active-matrix pixel array according to the claim 1, wherein the third period is later than the first period, and there is a fourth period between the third period and the first period, and the method further comprises:

during the third period, simultaneously inputting the reset signal into the control terminal of the second transistor of the each of the pixel circuits from the first terminal of the first transistor of the each of the pixel circuits.

9. The method for driving the active-matrix pixel array according to the claim 8, wherein the second period overlaps the first period and the fourth period.

10. The method for driving the active-matrix pixel array according to the claim 8, wherein second transistors of the different rows of the pixel circuits simultaneously receive the reset signal during the third period.

11. The method for driving the active-matrix pixel array according to the claim 8, wherein a time length of one frame period is equal to or greater than a sum of time lengths of the first period, the third period and the fourth period.

12. The method for driving the active-matrix pixel array according to the claim 8, wherein the second period is divided into a plurality of second sub-periods.

13. The method for driving the active-matrix pixel array according to the claim 1, wherein the second period is divided into a plurality of second sub-periods, the third period is later than the first period, and there is a fifth period between the first period and the third period.

14. The method for driving the active-matrix pixel array according to the claim 13, wherein the second period overlaps the first period, the third period and the fifth period.

15. The method for driving the active-matrix pixel array according to the claim 13, wherein a time length of one frame period is equal to or greater than a sum of time lengths of the first period, the third period and the fifth period.

16. The method for driving the active-matrix pixel array according to the claim 13, wherein a time length of the third period is shorter than a time length of the first period.

17. The method for driving the active-matrix pixel array according to the claim 13, wherein a time length of each of the second sub-periods is shorter than a time length of the third period.

18. The method for driving the active-matrix pixel array according to the claim 1, wherein the first period is divided into a plurality of first sub-periods, and the third period is divided into a plurality of third sub-periods, wherein each of the third sub-periods is earlier than each corresponding of the first sub-periods.

19. The method for driving the active-matrix pixel array according to the claim 18, wherein there is a six period after a final first sub-period, and a time length of one frame period is equal to or greater than a sum of time lengths of the first period, the third period and the sixth period.

20. The method for driving the active-matrix pixel array according to the claim 18, wherein the second period is divided into a plurality of second sub-periods.

* * * * *